US011419192B2

(12) United States Patent
Huang et al.

(10) Patent No.: US 11,419,192 B2
(45) Date of Patent: Aug. 16, 2022

(54) LIGHTING APPARATUS

(71) Applicant: XIAMEN ECO LIGHTING CO. LTD., Xiamen (CN)

(72) Inventors: Haifang Huang, Xiamen (CN); Xiaowei Chen, Xiamen (CN); Wenchang Huang, Xiamen (CN); Wenbin Lin, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 63 days.

(21) Appl. No.: 16/847,212

(22) Filed: Apr. 13, 2020

(65) Prior Publication Data

US 2020/0337128 A1 Oct. 22, 2020

(30) Foreign Application Priority Data

Apr. 17, 2019 (CN) ..... 201910309219.2

(51) Int. Cl.

| | |
|---|---|
| ***H05B 45/14*** | (2020.01) |
| ***H05B 47/175*** | (2020.01) |
| ***H05B 45/44*** | (2020.01) |
| ***H05B 45/24*** | (2020.01) |

(52) U.S. Cl.

CPC ..... *H05B 45/14* (2020.01); *H05B 45/24* (2020.01); *H05B 45/44* (2020.01); *H05B 47/175* (2020.01)

(58) Field of Classification Search

CPC ..... H05B 45/00; H05B 45/10; H05B 45/14; H05B 45/20; H05B 45/24; H05B 45/44; H05B 47/10; H05B 47/175

See application file for complete search history.

(56) References Cited

U.S. PATENT DOCUMENTS

| | | | | |
|---|---|---|---|---|
| 10,278,255 | B1 * | 4/2019 | Wu | H05B 45/28 |
| 2014/0091723 | A1 * | 4/2014 | Kuo | H05B 45/3725 315/200 R |

* cited by examiner

*Primary Examiner* — Jimmy T Vu
(74) *Attorney, Agent, or Firm* — Chun-Ming Shih; Lanway IPR Services

(57) ABSTRACT

A lighting apparatus includes a light source, a detector and a driver. The light source includes a first set of LED modules and a second set of LED modules. The first set of LED modules and the second set of LED modules emit lights with different color temperatures. The detector is used for detecting an operation pattern corresponding to one of a plurality of operation modes. The operation pattern is transmitted from an operation on a wall switch electrically connected to the lighting apparatus. The driver generates a first current to the first set of LED modules and a second current to the second set of LED modules based on the operation mode associated with the detected operation pattern. The operation mode corresponding to both a corresponding luminance level and a corresponding color temperature at the same time.

19 Claims, 3 Drawing Sheets

LIGHTING APPARATUS

FIELD

The present invention is related to a lighting apparatus, and more particularly related to a lighting apparatus with a cost-effective solution on controlling lights.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

It is a long run from past technology to LED technology. Everything is changing while old user habit is kept at the same time. It is important to find new ways to leverage the advantage of the LED technology in even traditional light device setting.

SUMMARY

In some embodiments, a lighting apparatus includes a light source, a detector and a driver.

The light source includes a first set of LED modules and a second set of LED modules. The first set of LED modules and the second set of LED modules emit lights with different color temperatures.

The detector is used for detecting an operation pattern corresponding to one of a plurality of operation modes. The operation pattern is transmitted from an operation on a wall switch electrically connected to the lighting apparatus.

For example, a wall switch is connected to a light device installed on a ceiling. Users press the wall switch to turn on or to turn off the light device. In addition, users may use a rotating switch to change a luminance level of the light device if the light device is able to decode the operation and provides a corresponding action accordingly.

In addition to turn on or to turn off the light device, users may press consecutively for multiple times in a short time period, e.g. in 20 seconds. Pressing a button switch for three times within 5 seconds may correspond to a first operation mode. Pressing the same button switch for two times within 5 seconds may correspond to a second operation mode. Such operation patterns may be coded to the light device so that the light device may recognize the operation pattern and then to action accordingly.

The driver generates a first current to the first set of LED modules and a second current to the second set of LED modules based on the operation mode associated with the detected operation pattern. The operation mode corresponding to both a corresponding luminance level and a corresponding color temperature at the same time.

In some embodiments, the detector includes a current dispatching circuit for determining the first current and the second current to the first set of LED modules and the second set of LED modules respectively.

Specifically, a detector may be designed to parse the operation pattern and then to adjust directly for generate the first current and the second current separately to mix a desired luminance level and a desired color temperature.

In some embodiments, such detector may be designed with lower cost circuit combination, which may directly change the current behavior by properly dispatching currents to the first set of LED modules and the second set of LED modules. For example, when the driver generates a current output, the current output is divided into the first current and the second current automatically based on the value of the current output of the driver.

The driver may include rectifier, filter and other circuits for converting an external indoor power source like a 110V/220V alternating current source to a direct current power source that is suitable for driving LED modules. The operation pattern may be defined and to be recognized by the driver to generate several different corresponding output current values. The current dispatching responds to the different corresponding output currents and dispatch different ratio of the output current as the first current to the first set of LED modules and as the second current to the second set of LED modules. With such design, even there is a no complicated circuit to parse and to decode the operation pattern, the color temperature and the luminance level may be adjusted at the same according to the operation patterns.

In some embodiments, the first set of LED modules include multiple first LED modules connected in series. One end of the multiple first LED modules connected in series is connected a direct current output of the driver and the other end of the multiple second LED modules is connected to a first resistor and then to ground.

For example, the first set of LED modules includes multiple LED chips connected in series. There are two ends of at ends of such LED string. A direct current is supplied to such LED string making the LED string emitting light.

Although it is taken as an example for connecting the LED modules in series, other variation may be made due to different needs. The LED module mentioned above may include multiple LED chips, instead of only one LED chip or only one type of LED chip. In addition, the LED string may contain other form of connected LED modules.

In some embodiments, the second set of LED modules include multiple second LED modules connected in series. One end of the multiple second LED modules is connected to the direct current output of the driver module and the other end of the multiple second LED modules connected in series is connected to an output of a comparator. A first input of the comparator is connected to the ground, and a second input of the comparator is connected to a second resistor and then to the first resistor and then to the ground.

The comparator may be regarded as a switch that compares electronic signal. The current path is conducted, limited or turned off depending on the values input. The following disclosure explains in more details on how the comparator and resistors function in such circuit design.

In some embodiments, the direct current output has three levels corresponding to three of the operation modes. Mixed color temperatures of the first set of LED modules and the second set of LED modules are different corresponding to the three levels of the direct current output. For example, there are three operation modes corresponding to three sets of color temperatures and luminance levels. In such settings, there are three options to be chosen from different combinations of color temperatures and luminance levels.

In some embodiments, the first current flows from the first set of LED modules, then to the first resistor and then to the ground.

In some embodiments, the second current flows from the second set of LED modules, then to the output of the comparator, then to the input of the comparator, then to the second resistor, then to the first resistor, then to the ground.

In some embodiments, in a first operation mode, the direct current output is 100% of a maximum output, the first set of LED modules receives all the direct current output, and the second set of LED modules are turned off.

In some embodiments, a resistor value of the first resistor is set to ensure that the resistor value of the first resistor multiplies the direct current output is larger than the second input of the comparator.

In some embodiments, in a second operation mode, the direct current output is between 30% to 60% of a maximum output, wherein the first current flows from the first set of LED modules, then to the first resistor and then to the ground, wherein the second current flows from the second set of LED modules, then to the output of the comparator, then to the input of the comparator, then to the second resistor, then to the first resistor, then to the ground, wherein the first set of LED modules and the second set of LED modules together mix a mixed color temperature determined by a ratio between the first resistor and the second resistor.

In some embodiments, the second current multiplies the second resistor plus a sum of the first current and the second current multiplies the first resistor is kept less than the second input of the comparator.

In some embodiments, in a third operation mode, the direct current output is between 5% to 30% of a maximum output, the first set of LED modules are turned off and the second set of LED modules receives all the direct current output In some embodiments, a mixed color temperature by the first set of LED modules and the second set of LED modules is determined by a ratio between the first resistor and the second resistor.

In some embodiments, a mixed color temperature by the first set of LED modules and the second set of LED modules is determined by a ratio between the first resistor and the second resistor.

In some embodiments, the wall switch is an ON/OFF switch and the operation pattern is a pressed number for the ON/OFF switch in a predetermined time period.

In some embodiments, the wall switch is a rotation switch for generating a continuous value being divided into groups corresponding to the operation modes.

In some embodiments, the lighting apparatus may also include a bulb shell, wherein the first set of LED modules and the second set of LED modules are enclosed in the bulb shell.

In some embodiments, the lighting apparatus may also include a tubular housing, wherein the first set of LED modules and the second set of LED modules are enclosed in the tubular housing.

In some embodiments, the lighting apparatus may also include a downlight housing, wherein the first set of LED modules and the second set of LED modules are enclosed in the downlight housing.

In some embodiments, the lighting apparatus may also include a lens for converting an output light of the first set of LED modules and the second set of LED modules into a light beam.

With such design, a cost-effective solution is provided even without complicated circuit chips for providing both color temperature and luminance level adjustment.

DETAILED DESCRIPTION

Figure 4:
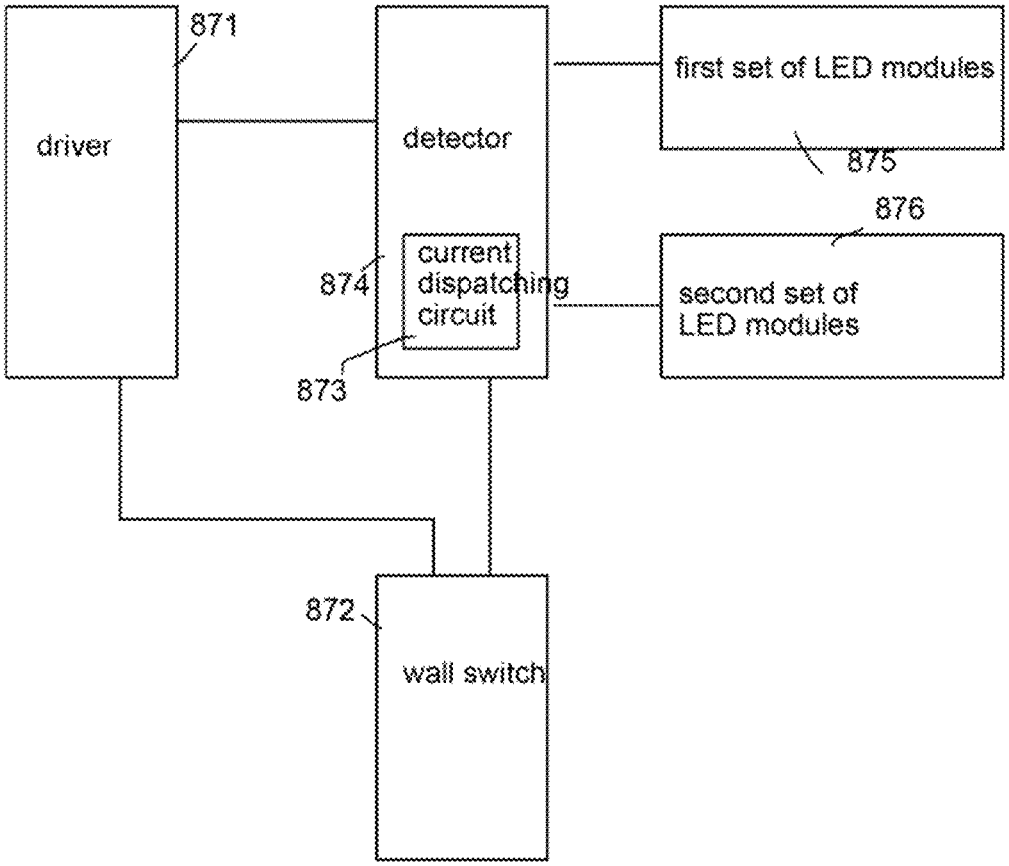
FIG. 4 is a diagram illustrating an architecture of a lighting apparatus example.

Please refer to FIG. 4, a lighting apparatus includes a light source, a detector 874 and a driver 871.

The light source includes a first set of LED modules 875 and a second set of LED modules 876. The first set of LED modules 875 and the second set of LED modules 876 emit lights with different color temperatures.

The detector 874 is used for detecting an operation pattern corresponding to one of a plurality of operation modes. The operation pattern is transmitted from an operation on a wall switch 872 electrically connected to the lighting apparatus.

For example, a wall switch is connected to a light device installed on a ceiling. Users press the wall switch to turn on or to turn off the light device. In addition, users may use a rotating switch to change a luminance level of the light device if the light device is able to decode the operation and provides a corresponding action accordingly.

In addition to turn on or to turn off the light device, users may press consecutively for multiple times in a short time period, e.g. in 20 seconds. Pressing a button switch for three times within 5 seconds may correspond to a first operation mode. Pressing the same button switch for two times within 5 seconds may correspond to a second operation mode. Such operation patterns may be coded to the light device so that the light device may recognize the operation pattern and then to action accordingly.

The driver 871 generates a first current to the first set of LED modules 875 and a second current to the second set of LED modules 876 based on the operation mode associated with the detected operation pattern. The operation mode corresponding to both a corresponding luminance level and a corresponding color temperature at the same time.

In FIG. 4, the detector 874 includes a current dispatching circuit 873 for determining the first current and the second current to the first set of LED modules 875 and the second set of LED modules 876 respectively.

Figure 2:
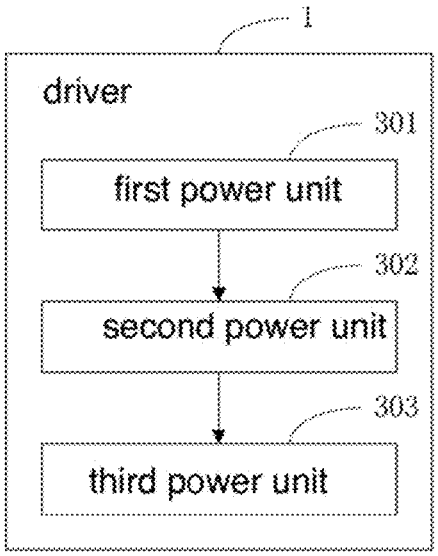
FIG. 2 is a diagram illustrating a driver.

In FIG. 2, a driver 1 includes a first power unit 301, a second power unit 302 and a third power unit 303. For three operation modes, three power units may be disposed in a driver for providing corresponding settings. But, the following example shows how to use a lower cost solution to achieve both color temperature and luminance level adjustment.

Figure 3:
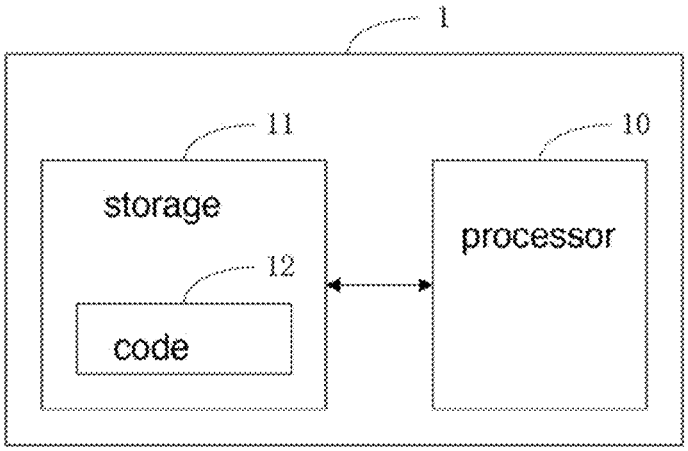
FIG. 3 is a diagram illustrating another driver.

In FIG. 3, the driver 1 includes a storage like a memory device which stores codes 12 that may be executed by a processor 10. This shows another way to achieve color temperature controlling. For example, the code 12 stores multiple settings and conditions to use such settings. The processor 10 executes the code 12 and generates corresponding control signals to trigger a current source to generate corresponding currents to achieve the needed effect.

Specifically, a detector may be designed to parse the operation pattern and then to adjust directly for generate the first current and the second current separately to mix a desired luminance level and a desired color temperature.

In some embodiments, such detector may be designed with lower cost circuit combination, which may directly change the current behavior by properly dispatching currents to the first set of LED modules and the second set of LED modules. For example, when the driver generates a current output, the current output is divided into the first current and the second current automatically based on the value of the current output of the driver.

The driver may include rectifier, filter and other circuits for converting an external indoor power source like a 110V/220V alternating current source to a direct current power source that is suitable for driving LED modules. The operation pattern may be defined and to be recognized by the driver to generate several different corresponding output current values. The current dispatching responds to the different corresponding output currents and dispatch different ratio of the output current as the first current to the first set of LED modules and as the second current to the second set of LED modules. With such design, even there is a no complicated circuit to parse and to decode the operation pattern, the color temperature and the luminance level may be adjusted at the same according to the operation patterns.

Figure 1:
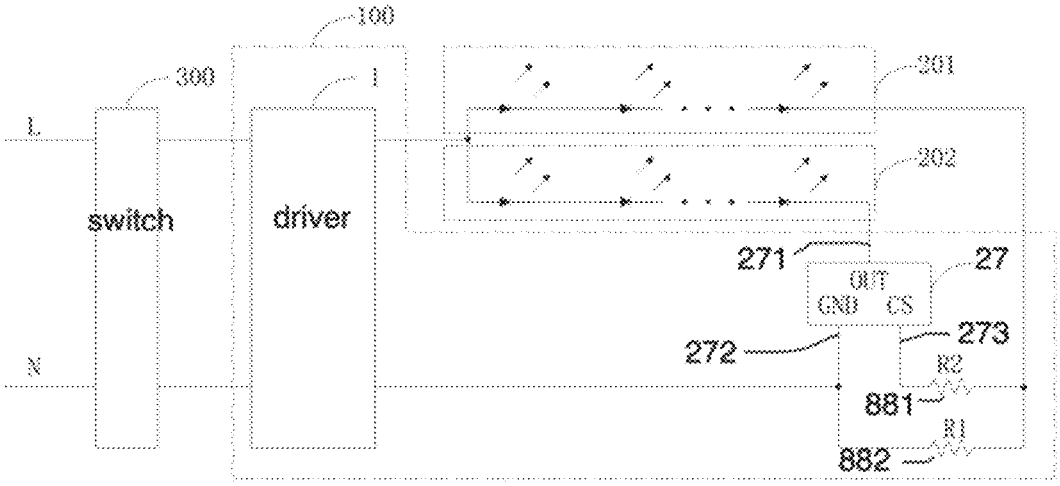
FIG. 1 shows a circuit diagram of an embodiment.

In FIG. 1, the first set of LED modules 201 include multiple first LED modules connected in series. One end of the multiple first LED modules connected in series is connected a direct current output of the driver 1 and the other end of the multiple second LED modules is connected to a first resistor 882 and then to ground.

For example, the first set of LED modules includes multiple LED chips connected in series. There are two ends of at ends of such LED string. A direct current is supplied to such LED string making the LED string emitting light.

Although it is taken as an example for connecting the LED modules in series, other variation may be made due to different needs. The LED module mentioned above may include multiple LED chips, instead of only one LED chip or only one type of LED chip. In addition, the LED string may contain other form of connected LED modules.

In FIG. 1, the second set of LED modules 202 include multiple second LED modules connected in series. One end of the multiple second LED modules 202 is connected to the direct current output of the driver 1 and the other end of the multiple second LED modules connected in series is connected to an output 271 of a comparator 27. A first input 272 of the comparator is connected to the ground, and a second input 273 of the comparator 27 is connected to a second resistor 881 and then to the first resistor 882 and then to the ground.

The comparator 27 may be regarded as a switch that compares electronic signal. The current path is conducted, limited or turned off depending on the values input. The following disclosure explains in more details on how the comparator and resistors function in such circuit design.

In some embodiments, the direct current output has three levels corresponding to three of the operation modes. Mixed color temperatures of the first set of LED modules and the second set of LED modules are different corresponding to the three levels of the direct current output. For example, there are three operation modes corresponding to three sets of color temperatures and luminance levels. In such settings, there are three options to be chosen from different combinations of color temperatures and luminance levels.

In some embodiments, the first current flows from the first set of LED modules, then to the first resistor and then to the ground.

In some embodiments, the second current flows from the second set of LED modules, then to the output of the comparator, then to the input of the comparator, then to the second resistor, then to the first resistor, then to the ground.

In some embodiments, in a first operation mode, the direct current output is 100% of a maximum output, the first set of LED modules receives all the direct current output, and the second set of LED modules are turned off.

In some embodiments, a resistor value of the first resistor is set to ensure that the resistor value of the first resistor multiplies the direct current output is larger than the second input of the comparator.

In some embodiments, in a second operation mode, the direct current output is between 30% to 60% of a maximum output, wherein the first current flows from the first set of LED modules, then to the first resistor and then to the ground, wherein the second current flows from the second set of LED modules, then to the output of the comparator, then to the input of the comparator, then to the second resistor, then to the first resistor, then to the ground, wherein the first set of LED modules and the second set of LED modules together mix a mixed color temperature determined by a ratio between the first resistor and the second resistor.

In some embodiments, the second current multiplies the second resistor plus a sum of the first current and the second current multiplies the first resistor is kept less than the second input of the comparator.

In some embodiments, in a third operation mode, the direct current output is between 5% to 30% of a maximum output, the first set of LED modules are turned off and the second set of LED modules receives all the direct current output In some embodiments, a mixed color temperature by the first set of LED modules and the second set of LED modules is determined by a ratio between the first resistor and the second resistor.

In some embodiments, a mixed color temperature by the first set of LED modules and the second set of LED modules is determined by a ratio between the first resistor and the second resistor.

In some embodiments, the wall switch is an ON/OFF switch and the operation pattern is a pressed number for the ON/OFF switch in a predetermined time period.

In some embodiments, the wall switch is a rotation switch for generating a continuous value being divided into groups corresponding to the operation modes.

In some embodiments, the lighting apparatus may also include a bulb shell, wherein the first set of LED modules and the second set of LED modules are enclosed in the bulb shell.

In some embodiments, the lighting apparatus may also include a tubular housing, wherein the first set of LED modules and the second set of LED modules are enclosed in the tubular housing.

In some embodiments, the lighting apparatus may also include a downlight housing, wherein the first set of LED modules and the second set of LED modules are enclosed in the downlight housing.

In some embodiments, the lighting apparatus may also include a lens for converting an output light of the first set of LED modules and the second set of LED modules into a light beam.

With such design, a cost-effective solution is provided even without complicated circuit chips for providing both color temperature and luminance level adjustment.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source comprising a first set of LED modules and a second set of LED modules, the first set of LED modules and the second set of LED modules emitting lights with different color temperatures;

a detector for detecting an operation pattern corresponding to one of a plurality of operation modes, the operation pattern being transmitted from an operation on a wall switch electrically connected to the lighting apparatus;

a driver generating a first current to the first set of LED modules and a second current to the second set of LED modules based on the operation mode associated with the detected operation pattern, the operation mode corresponding to both a corresponding luminance level and a corresponding color temperature at the same time, wherein the detector comprises a current dispatching circuit for determining the first current and the second current to the first set of LED modules and the second set of LED modules respectively.

2. The lighting apparatus of claim 1, wherein the first set of LED modules comprise multiple first LED modules connected in series, one end of the multiple first LED modules connected in series is connected a direct current output of the driver and the other end of the multiple second LED modules is connected to a first resistor and then to ground.

3. The lighting apparatus of claim 2, wherein the second set of LED modules comprise multiple second LED modules connected in series, one end of the multiple second LED modules is connected to the direct current output of the driver module and the other end of the multiple second LED modules connected in series is connected to an output of a comparator, a first input of the comparator is connected to the ground, and a second input of the comparator is connected to a second resistor and then to the first resistor and then to the ground.

4. The lighting apparatus of claim 3, wherein the direct current output has three levels corresponding to three of the operation modes, mixed color temperatures of the first set of LED modules and the second set of LED modules are different corresponding to the three levels of the direct current output.

5. The lighting apparatus of claim 4, wherein the first current flows from the first set of LED modules, then to the first resistor and then to the ground.

6. The lighting apparatus of claim 5, wherein the second current flows from the second set of LED modules, then to the output of the comparator, then to the input of the comparator, then to the second resistor, then to the first resistor, then to the ground.

7. The lighting apparatus of claim 4, wherein in a first operation mode, the direct current output is 100% of a maximum output, the first set of LED modules receives all the direct current output, and the second set of LED modules are turned off.

8. The lighting apparatus of claim 7, wherein a resistor value of the first resistor is set to ensure that the resistor value of the first resistor multiplies the direct current output is larger than the second input of the comparator.

9. The lighting apparatus of claim 4, wherein in a second operation mode, the direct current output is between 30% to 60% of a maximum output, wherein the first current flows from the first set of LED modules, then to the first resistor and then to the ground, wherein the second current flows from the second set of LED modules, then to the output of the comparator, then to the input of the comparator, then to the second resistor, then to the first resistor, then to the ground, wherein the first set of LED modules and the second set of LED modules together mix a mixed color temperature determined by a ratio between the first resistor and the second resistor.

10. The lighting apparatus of claim 9, wherein the second current multiplies the second resistor plus a sum of the first current and the second current multiplies the first resistor is kept less than the second input of the comparator.

11. The lighting apparatus of claim 4, wherein in a third operation mode, the direct current output is between 5% to 30% of a maximum output, the first set of LED modules are turned off and the second set of LED modules receives all the direct current output.

12. The lighting apparatus of claim 11, wherein a mixed color temperature by the first set of LED modules and the second set of LED modules is determined by a ratio between the first resistor and the second resistor.

13. The lighting apparatus of claim 3, wherein a mixed color temperature by the first set of LED modules and the second set of LED modules is determined by a ratio between the first resistor and the second resistor.

14. The lighting apparatus of claim 1, wherein the wall switch is an ON/OFF switch and the operation pattern is a pressed number for the ON/OFF switch in a predetermined time period.

15. The lighting apparatus of claim 1, wherein the wall switch is a rotation switch for generating a continuous value being divided into groups corresponding to the operation modes.

16. The lighting apparatus of claim 1, further comprising a bulb shell, wherein the first set of LED modules and the second set of LED modules are enclosed in the bulb shell.

17. The lighting apparatus of claim 1, further comprising a tubular housing, wherein the first set of LED modules and the second set of LED modules are enclosed in the tubular housing.

18. The lighting apparatus of claim 1, further comprising a downlight housing, wherein the first set of LED modules and the second set of LED modules are enclosed in the downlight housing.

19. The lighting apparatus of claim 1, further comprising a lens for converting an output light of the first set of LED modules and the second set of LED modules into a light beam.

* * * * *